US008479936B2

(12) United States Patent
Gruenwald et al.

(10) Patent No.: US 8,479,936 B2
(45) Date of Patent: Jul. 9, 2013

(54) WATER BOTTLE WITH DOSAGE CUP

(76) Inventors: Eric William Gruenwald, Dallas, TX (US); Lawrence Lambelet, Flemington, NJ (US); Patrick James Mulligan, Dallas, TX (US)

( * ) Notice: Subject to any disclaimer, the term of this patent is extended or adjusted under 35 U.S.C. 154(b) by 255 days.

(21) Appl. No.: 12/704,902

(22) Filed: Feb. 12, 2010

(65) Prior Publication Data

US 2010/0230375 A1 Sep. 16, 2010

Related U.S. Application Data

(60) Provisional application No. 61/158,828, filed on Mar. 10, 2009.

(51) Int. Cl.
*B65D 41/38* (2006.01)
*B65D 41/34* (2006.01)

(52) U.S. Cl.
USPC ..... 215/253; 220/266; 220/265

(58) Field of Classification Search
USPC ..... 215/254, 253, 251, 228, 250, 200, 215/278, 277; 220/257.2, 257.1, 256.1, 254.1, 220/270, 266, 265, 522, 521, 260; 206/532, 206/540, 539, 538; 222/153.1, 153.09, 541.9, 222/541.6, 541.1; 53/471, 467, 488, 485, 53/484
IPC ..... B65D 41/38,41/34, 41/32, 41/62, 17/34, B65D 17/28
See application file for complete search history.

(56) References Cited

U.S. PATENT DOCUMENTS

| | | | | | |
|---|---|---|---|---|---|
| 525,753 | A | | 9/1894 | Turner | |
| 526,772 | A | | 10/1894 | Dickerson | |
| 2,643,015 | A | * | 6/1953 | Soffer | 215/253 |
| 2,766,796 | A | * | 10/1956 | Tupper | 220/521 |
| 2,806,620 | A | * | 9/1957 | Blanch | 215/251 |
| 2,915,404 | A | * | 12/1959 | Tessmer et al. | 426/118 |
| 2,941,689 | A | * | 6/1960 | Black | 220/522 |
| 3,368,707 | A | * | 2/1968 | Brown et al. | 215/254 |
| 3,433,378 | A | * | 3/1969 | Ross | 215/6 |
| 4,150,761 | A | * | 4/1979 | Collins | 215/228 |
| 4,264,007 | A | * | 4/1981 | Hunt | 206/219 |
| 4,273,247 | A | * | 6/1981 | Earls | 215/228 |
| 4,565,294 | A | * | 1/1986 | Smith | 215/251 |
| 4,618,444 | A | * | 10/1986 | Hudson et al. | 8/111 |
| 4,624,378 | A | * | 11/1986 | Sawicki | 215/230 |
| 4,756,436 | A | * | 7/1988 | Morita et al. | 215/228 |
| 4,966,780 | A | | 10/1990 | Hargraves | |
| 4,984,700 | A | * | 1/1991 | Knickerbocker | 215/251 |
| 6,024,221 | A | | 2/2000 | Yuyama | |
| 6,050,436 | A | * | 4/2000 | Bennett et al. | 215/256 |

(Continued)

OTHER PUBLICATIONS

Calcomp Nutrition, "Centrophenoxine Anti Aging Gocnitive Enhancer by Unique Nutrition", Wayback Machine, http://www.calcompnutrition.com/centrophenoxine.html, Aug. 30, 2006, pp. 1-2.*

*Primary Examiner* — Robert J Hicks
(74) *Attorney, Agent, or Firm* — Lawrence Lambelet

(57) ABSTRACT

The present invention provides an enhanced water product, wherein a solid dosage product is conveyed with a bottle of water in an attached dosage cup. The attachment is achieved with a novel frangible feature that flexes out of the way during a simplified snap-on assembly. The feature breaks away when any attempt is made to separate the dosage cup from bottle, thus rendering the product safe from malicious tampering. In an alternate embodiment, the dosage cup is used to measure any liquid product.

18 Claims, 7 Drawing Sheets

U.S. PATENT DOCUMENTS

| | | | | |
|---|---|---|---|---|
| 6,596,328 | B1 | 7/2003 | Bezek | |
| 7,296,700 | B2 | 11/2007 | Steele | |
| 2007/0089341 | A1* | 4/2007 | Liao | 40/611.05 |
| 2008/0000786 | A1 | 1/2008 | Collotta | |
| 2009/0032546 | A1* | 2/2009 | Litherland et al. | 221/2 |
| 2010/0183776 | A1* | 7/2010 | Gruenwald et al. | 426/115 |

* cited by examiner

Detail A

Detail B

WATER BOTTLE WITH DOSAGE CUP

CROSS-REFERENCE TO RELATED APPLICATIONS

This application claims priority to U.S. Provisional Application 61/158,828, filed Mar. 10, 2009.

FIELD OF THE INVENTION

This invention relates to bottled water products, and more particularly to a nutritionally enhanced drink.

BACKGROUND OF THE INVENTION

Additives are commonly sold in combination with bottled water. Currently marketed examples include energy, or health, drinks, where the additive is provided in solution form. Other examples include a medication where the bottled water is supplied simply as a convenience for washing down a pill or a capsule.

In particular instances involving nutritional supplements, however, it is useful to supply the supplement in solid dosage form, similar to the medication example. Doing so improves the shelf stability of a natural active ingredient, and particularly one of a biological derivation, which might otherwise degrade or lose potency over time when in dissolution.

In contrast with the medication circumstance, however, the water is not just a convenience for administering the dosage. It is also a measured amount of ingredient required for the best metabolic results. Therefore, the means for combining the two components into a single package is an important aspect of the product put-up. One such means is with a dose cup inverted over the bottle cap.

Dose cups attached to bottles containing liquid products are known. In U.S. Pat. No. 526,772 to Dickerson and U.S. Pat. No. 525,753 to Turner, for example, a dose cup having measurement graduations is locked onto the neck of a bottle containing a liquid preparation by screw-thread or lug mechanisms. In U.S. Pat. No. 7,296,700 to Steele, a dosage cup is coupled to the cap of a bottle containing a liquid nutritional supplement. A friction fit with shoulder-like appendages in the cup provides the mechanism for attachment to the cap in this case.

The attachment means used for the above instances are not particularly secure, either in terms of retaining the cup or in terms of tamper-safety. In the marketplace of today, a well-known liquid product for cold and flu relief, branded Vicks® NyQuil®, provides a dose cup secured to the neck flange of a bottle by means of a shrink band. Shrink bands are considered to be tamper-indicating in certain cases, and the enshroudment of the cup prevents unintended separation. In U.S. Patent Application 2008/0000786 to Collotta, a secondary cap, in the configuration of a cup, creates a chamber to house a solid dosage preparation in the form of pills or capsules for a companion water bottle. The cup is held in place by a body-type shrink band.

The cup-over-cap provides a convenient means for packaging a nutritional solid dosage preparation with a measured amount of water. Transparency can be easily modulated to provide either visibility to the product or protection from harmful radiation. It also provides a convenient and sanitary way to handle the dosage when removed from the bottle. The shrink banding, on the other hand, has drawbacks. Because heat must be applied, there is a risk of degradation to a temperature-sensitive product. Furthermore, the operation represents an investment in equipment, an additional step in the production process, and an additional material expense. Lastly, the customer is inconvenienced by having to strip away the band.

The unfulfilled need is for a tamper-indicating put-up, whereby a cup assembled to a bottle containing a liquid provides a container for an accompanying solid dosage product in a simple, snap-together process avoiding the application of heat.

SUMMARY OF THE INVENTION

It is accordingly an object of the present invention to provide a dose cup attached to a bottle of liquid product for measuring out or handling doses.

It is further object of the present invention to provide a nutritional supplement in an interior space of a dose cup inverted over the cap of a bottle of water.

It is a further object of the present invention to attach the dose cup to the bottle of water without applying heat to the nutritional supplement.

It is a further object of the present invention to perform the attachment in a single assembly step.

It is a further object of the present invention to provide an indicator for product tampering.

It is a further object of the present invention to make the attachment secure for shipping and handling purposes while suitably frangible for access to the contained products.

These objects, and others to become hereinafter apparent, are embodied in an enhanced water product with a safety feature, comprising a water bottle containing water and having a neck finish and a neck flange operable with a closure. The closure is sealing fitted to the neck finish and has a top surface. The enhanced water product further comprises an inverted frusto-conical cup having a sidewall interior surface, a top rim and a bottom. The inverted frusto-conical cup forms a chamber between the bottom and the top surface of the closure with the sidewall interior surface resting on the neck flange. The top rim has a diameter broader than the neck flange. The enhanced water product further comprises a solid dosage product contained within the chamber. The enhanced water product finally comprises a means for frangibly coupling the inverted frusto-conical cup to the neck flange, said means engaged during the act of assembling the inverted frusto-conical cup to the water bottle, the engagement providing both physical and tamper-indicating security of the assembly.

In a preferred embodiment, the means for frangibly coupling comprises a boss extending radially inward from the sidewall interior surface, the boss capable of flexing out of the way during passage over the neck flange and of snagging there under to form the engagement. The means for frangibly coupling additionally comprises a flexible sidewall. The top rim diameter is sufficiently broad to allow the flexed boss to bypass the flange when the sidewall is flexed into an ovate shape during assembly. The engaged boss separates from the sidewall and releases the inverted frusto-conical cup when a predetermined force is applied thereto, the separation constituting a telltale of the act.

In a particularly preferred embodiment, the boss is attached to a separable portion of the sidewall, which, in turn, is attached to the sidewall by a plurality of breakable filaments. The predetermined force is a hand pressure applied to the inverted frusto-conical cup of sufficient strength and direction to break the breakable filaments.

In an alternate embodiment, the same mechanism is used to assemble a frusto-conical cup to a bottle containing a liquid, the cup serving to measure out the liquid.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 1:
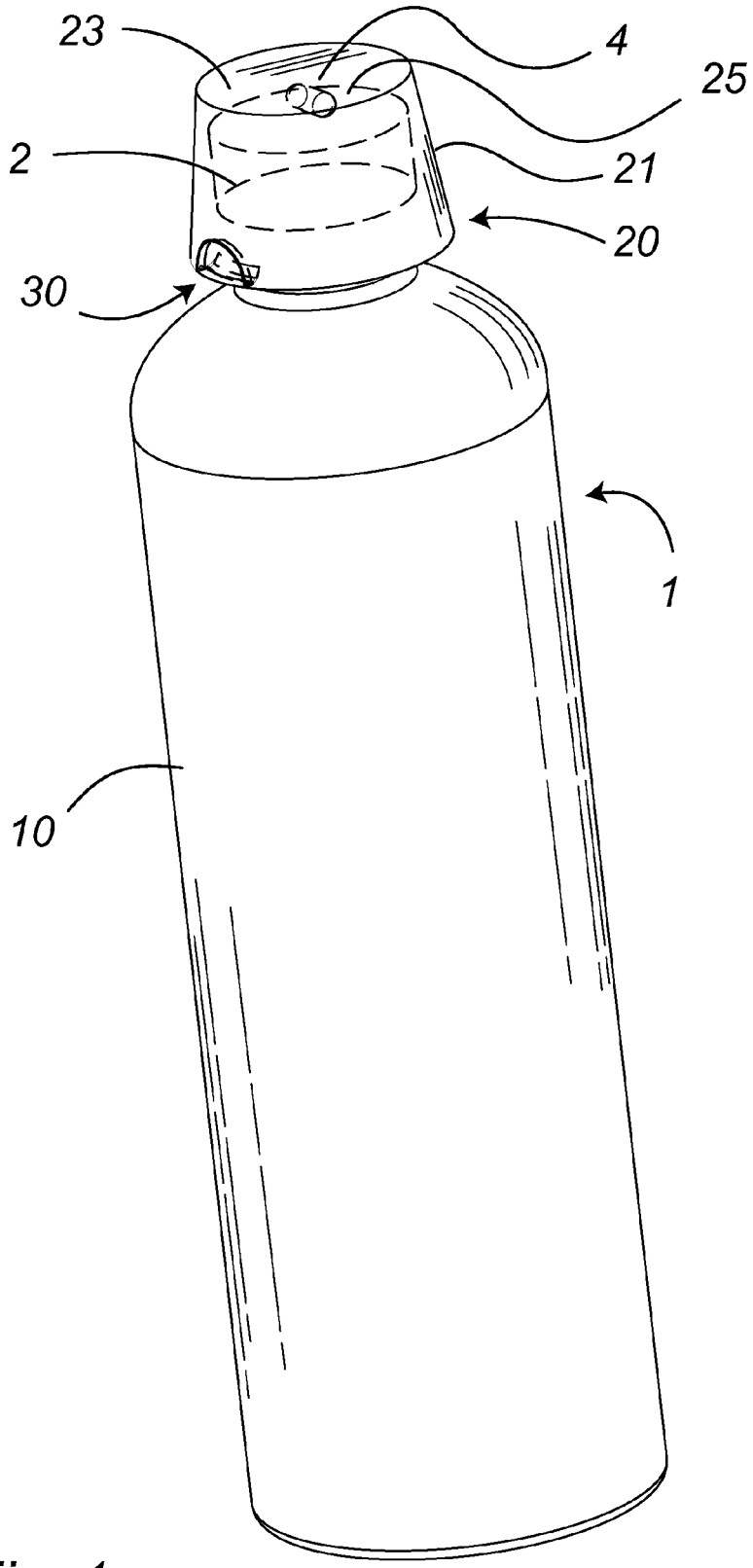
FIG. 1 is a perspective view of the enhanced water product of the present invention with the cap and solid dosage shown in hidden line.
Figure 2:
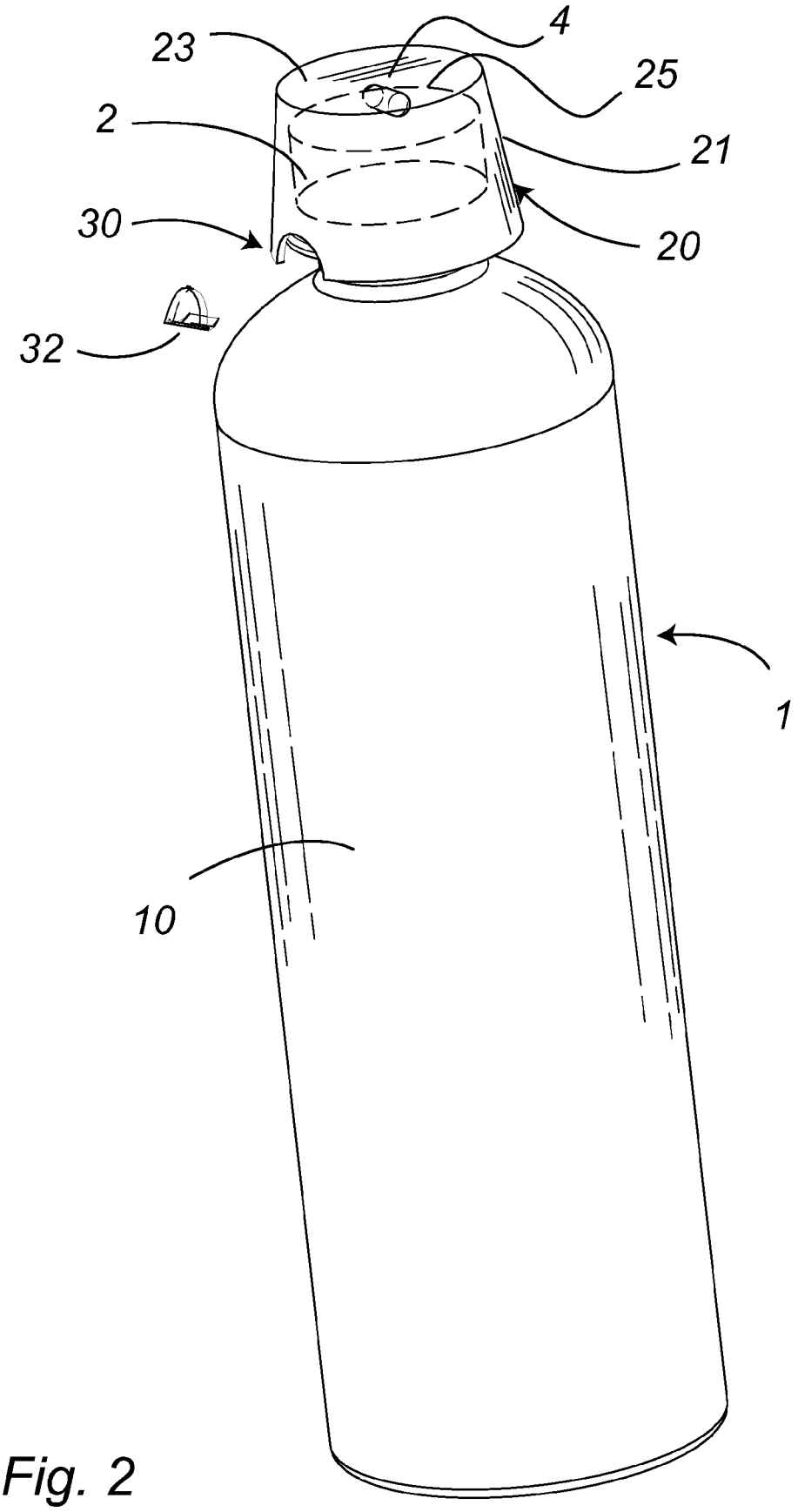
FIG. 2 is a perspective view of the enhanced water product with the cap and solid dosage is shown in hidden line with a feature broken away.
Figure 3:
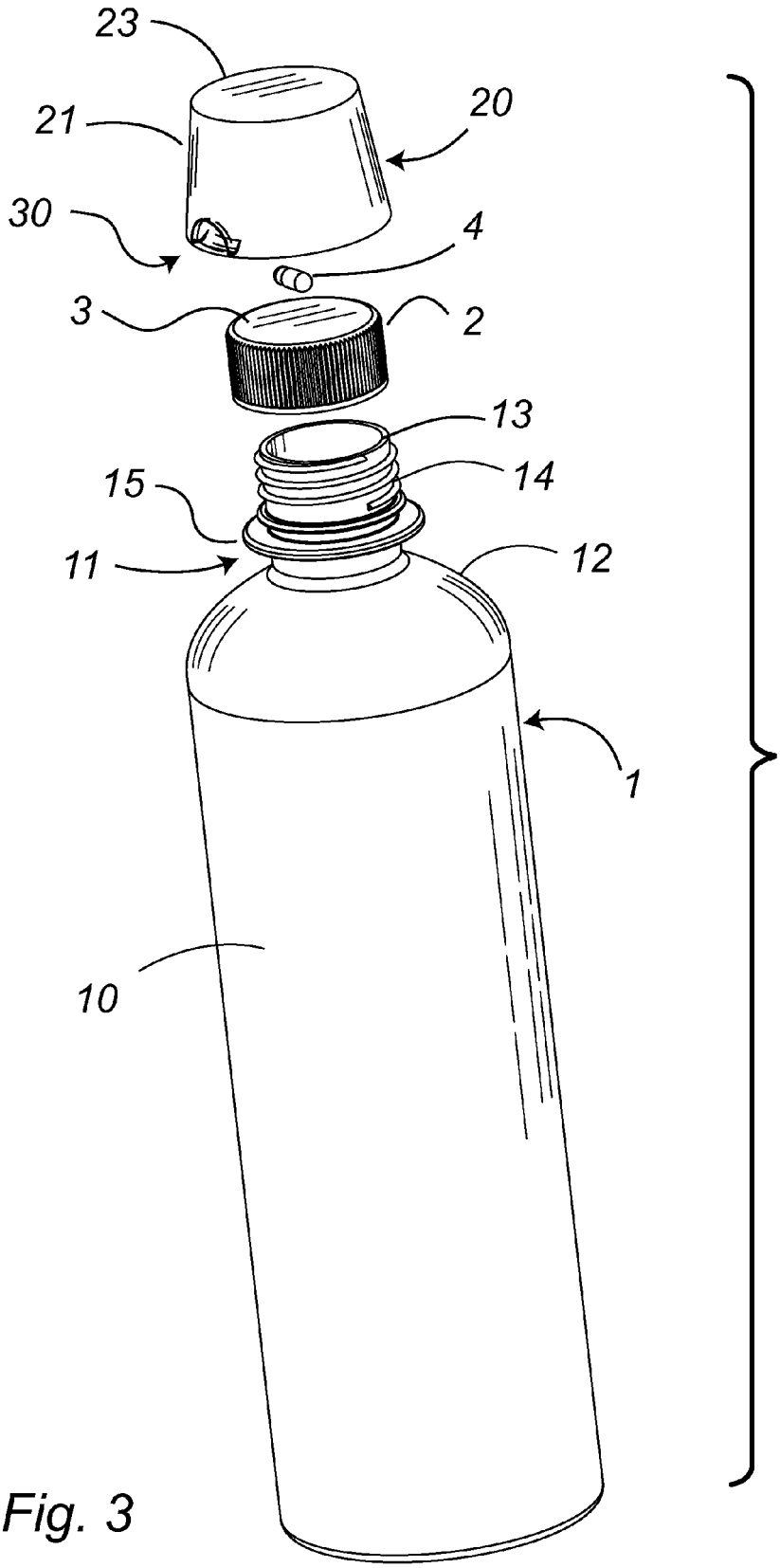
FIG. 3 is an exploded perspective view of the enhanced water product.
Figure 5:
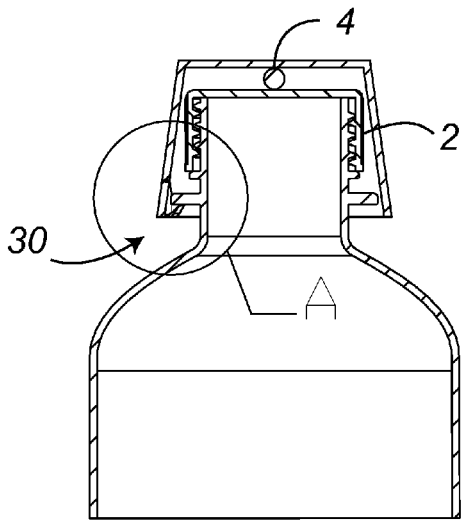
FIG. 5 is a partial sectional view taken along the lines 5-5 of FIG. 4.
Figure 6:
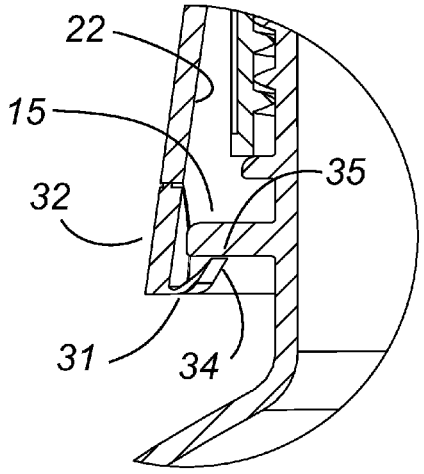
FIG. 6 is a detail view of a portion of the partial sectional view of FIG. 5.
Figure 4:
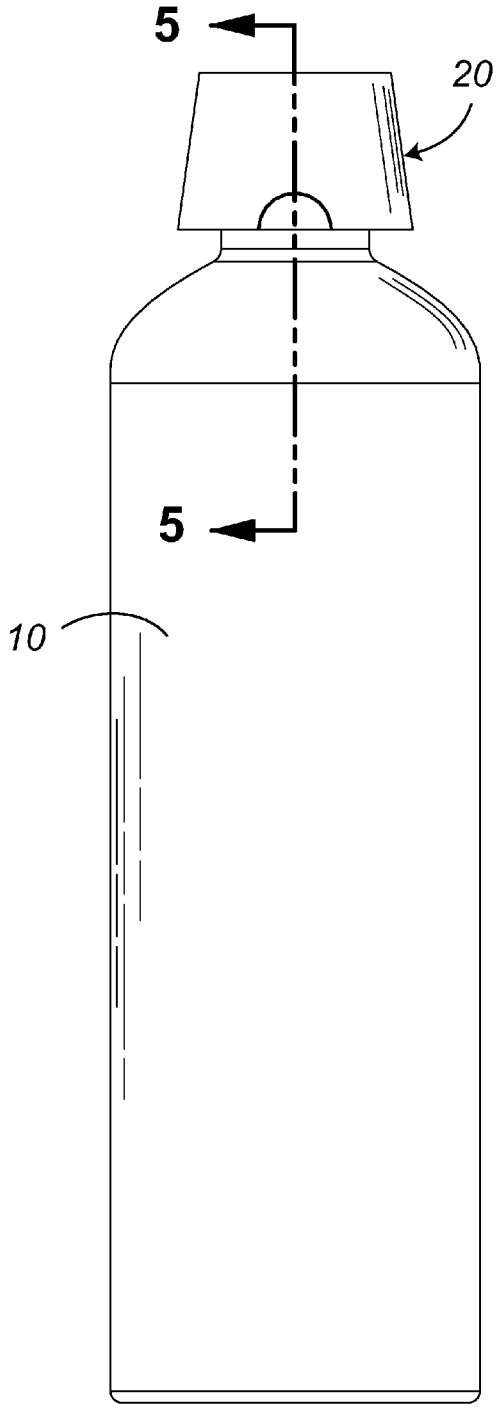
FIG. 4 is an elevation view of the enhanced water product.
Figure 7:
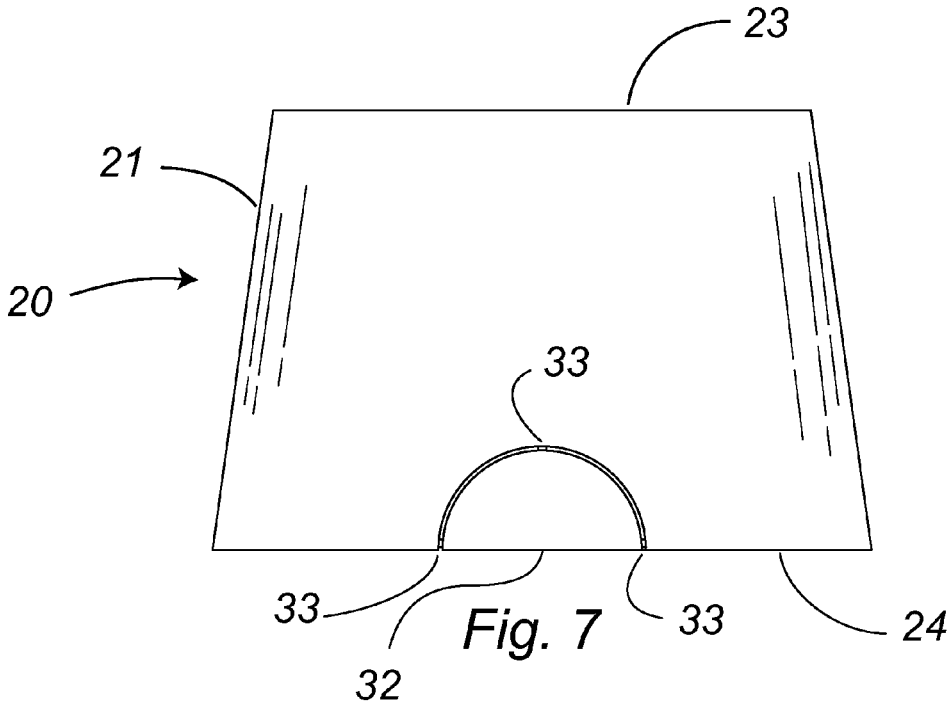
FIG. 7 is an elevation view of the dose cup of the invention.
Figure 8:
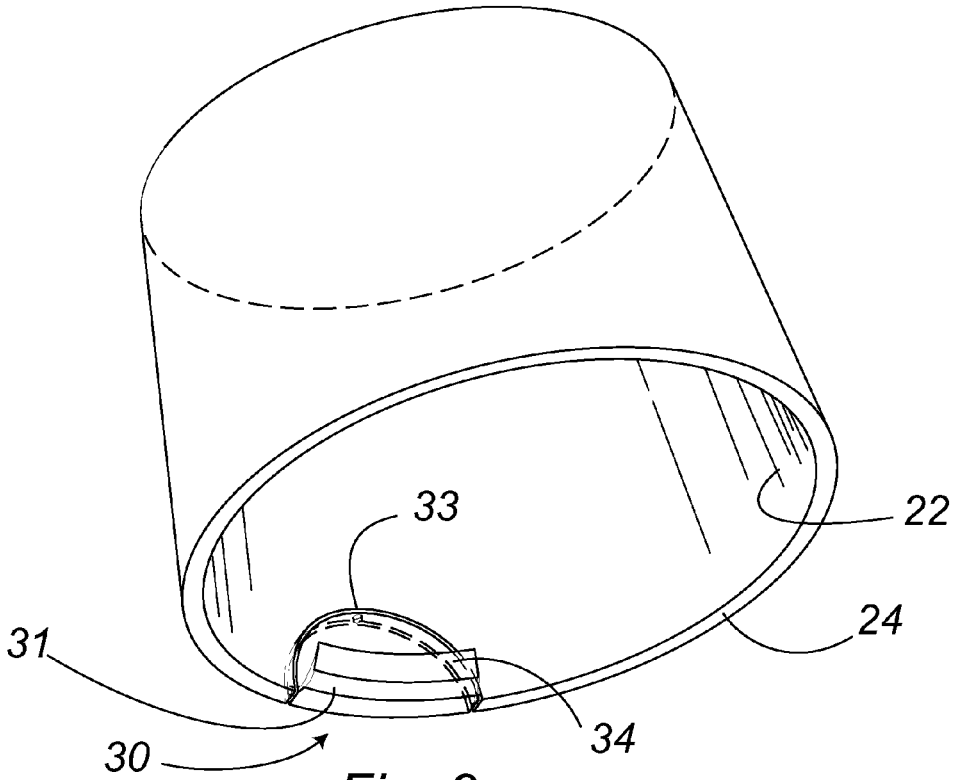
FIG. 8 is a bottom perspective view of the dose cup.
Figure 10:
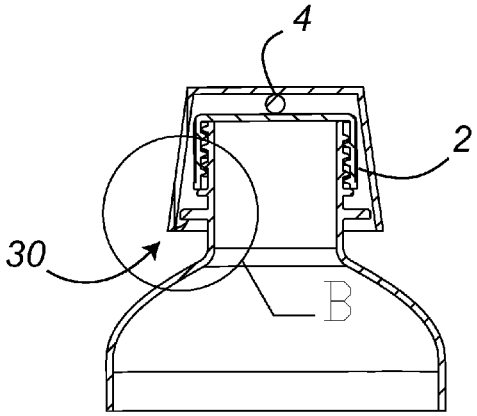
FIG. 10 is a partial sectional view taken along the lines 10-10 of FIG. 9.
Figure 11:
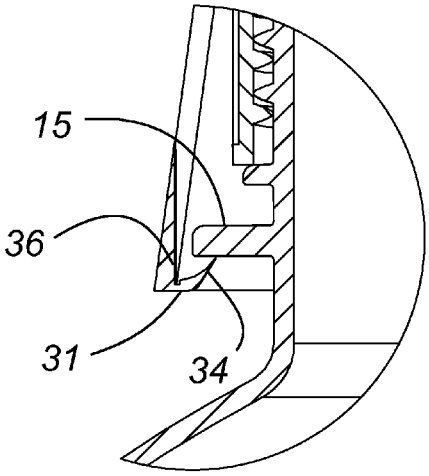
FIG. 11 is a detail view of a portion of the partial sectional view of FIG. 10.
Figure 9:
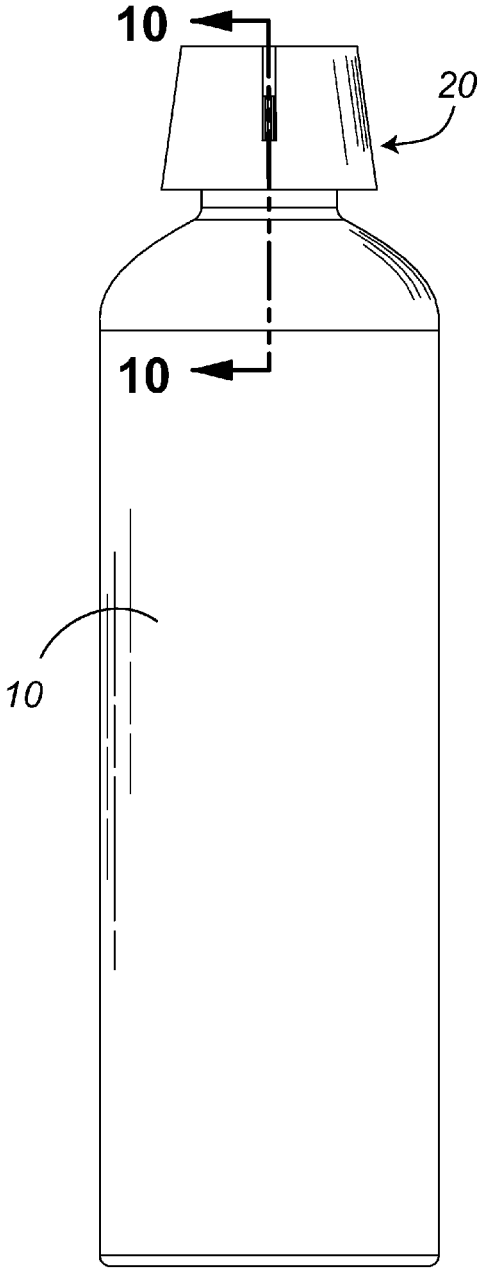
FIG. 9 is an elevation view of an alternate embodiment of the enhanced water product.

The constituent components of the present invention are best shown in the exploded view of FIG. 3. An enhanced water product 1 is comprised of a water bottle 10, a closure 2, a solid dosage product 4 and a frusto-conical cup 20. FIG. 1 shows the components in assembly with dotted lines indicating by outline the closure 2 and the solid dosage product 4 enclosed by the frusto-conical cup 20. FIG. 2 shows a separable portion 32 of a means for frangibly coupling 30 the frusto-conical cup 20 to the water bottle 10. As a following discussion will show, the separable portion 32 comprises a safety feature of the enhanced water product 1.

Referring to FIG. 3, the water bottle 10 is comprised of a neck 11, a shoulder 12, a neck finish 13, and a neck flange 15. The neck 11 joins the shoulder 12 to form an opening for the water bottle 10. The water bottle 10 is a container generally filled with water, but may contain any liquid suitable for a nutritional regimen. In the preferred embodiment, the neck finish 13 has there around threads 14 configured for engaging complementary features of the closure 2. When the closure 2 is threadingly engaged with the neck finish 13, the water bottle 10 is sealed. The closure 2 may also engage by any alternate means known in the art.

The neck flange 15 extends radially outward from the neck 11 below the seated closure 2. The extension of the neck flange 15 is sufficient to allow the frusto-conical cup 20 to seat thereon without interference from the closure 2. The position of the neck flange 15 above the shoulder 12 is sufficient to permit the frusto-conical cup 20 to overlap the neck flange 15 when seated thereon.

The closure 2 has a top surface 3. The solid dosage product 4 rests on the top surface 3 when assembled thereto. The solid dosage product 4 may be a tablet or a capsule, or may be a plurality individually, or a mixture, thereof. The solid dosage product 4 may be contained in a sealed pouch 5 (not shown). The sealed pouch 5 may be comprised of a heat-sealed film, such as that commonly used for sanitation purposes. In the preferred embodiment, the sealed pouch 5 is visually transparent so that the solid dosage product 4 can be inspected.

As shown in FIGS. 1-3, 7, and 8, the frusto-conical cup 20 has a flared sidewall 21, a bottom 23 and a top rim 24. The flared sidewall 21 has a sidewall interior surface 22. When assembled to water bottle 10, the sidewall interior surface 22 rests on the neck flange 15 to define a chamber 25 between the bottom 23 of the frusto-conical cup 20 and the top surface 3 of the closure 2. The flare of the sidewall is such that the diameter of the top rim 24 is greater than the diameters of the bottom 23 and the neck flange 15. The slope of the flare is roughly defined by the sections of the frusto-conical cup 20 intersected by the planes of the top surface 3 and the contact profile of the neck flange 15. The chamber 25 is of sufficient volume to contain the solid dosage product 4 therein. The flared sidewall 21 is sufficiently flexible as to change the top rim 24 from a circular shape to an ovate shape and sufficiently resilient as to resume the circular shape thereafter. In the preferred embodiment, the frusto-conical cup 20 is visually transparent, or at least translucent, but may contain spectral filters to prevent the degradation of the solid dosage product 4.

The means for frangibly coupling 30 is best shown in FIGS. 4-8. The means for frangibly coupling 30 comprises a boss 31 extending radially inward from the sidewall interior surface 22 adjacent the top rim 24 of the frusto-conical cup 20 to underlap the neck flange 15. The boss 31 has a tapered lip 34 which angles upwardly and inwardly to make contact with the underside of the neck flange 15, thereby coupling the frusto-conical cup 20 to the water bottle 10 with interfering structure. The tapered lip 34 diminishes in thickness toward a tip end 35, whereby the tip is made progressively flexible. The angle is of the tapered lip 34 is such as to urge the top rim 24 of the frusto-conical cup 20 into an ovate shape when the frusto-conical cup is forced downward over the closure 2 and the neck flange 15. The ovate shape is optimized by sizing of the top rim 24 and the boss 31 to provide minimal clearance for the tip end 35 in its extreme flexed position to bypass the neck flange 15 and snap thereunder.

Because the neck flange 15 is forced to reside, by means of tapered lip 34, at a cross-section of the frusto-conical cup 20 which is smaller in diameter than that of the top rim 24, thereby reducing available bypass clearance, and because the upward and outward angle of the tapered lip 34 effectively lengthens the boss 31 when an attempt is made to lift the frusto-conical cup 20, the frusto-conical cup is effectively captured by the boss 31. The frusto-conical cup 20 can be further secured by lowering the top rim 24 toward the shoulder 12, whereby the gap there between is narrowed sufficiently to prevent manipulation of the tapered lip 34 there through. Similarly, the frusto-conical cup 20 cannot be tipped off the water bottle 10 from an opposite leverage point with the sidewall interior surface 22 positioned sufficiently close to the closure 2 (see FIG. 5).

The means for frangibly coupling 30 further comprises the separable portion 32. The separable portion 32 supports the boss 31 and forms a part of the flared sidewall 21, to which it is connected by a multiplicity of breakable filaments 33. The breakable filaments 33 are sufficiently frangible as to shear apart when a downward pressure is applied to the boss 31. Such a downward pressure occurs when an attempt is made to lift the frusto-conical cup 20 away from the water bottle 10. The lifting of the frusto-conical cup 20 causes the separable portion 32 to experience a shearing force cantilevered by the boss 31. When the breakable filaments 33 are thusly sheared, the separable portion 32 drops away and the frusto-conical cup 20 is freed from the water bottle 10 in evidence of the act. In such a way, the separable portion 32 constitutes a tamper-indicating feature.

An alternate embodiment of the means for frangibly coupling 30 is shown in FIGS. 9-13. In this embodiment, the separable portion 32 and the breakable filaments 33 are replaced by a notch 36 at the base of the boss 31. The notch 36 provides a weakened point in the structure of boss 31 that will sustain a compression force while giving away under a tension force. When the tapered lip 34 of the boss 31 is flexed in response to forcing the frusto-conical cup 20 downward over the neck flange 15, a compressive force is applied to the notch 36, wherein the gap of the notch, given sufficiently narrow breadth, provides strain relief for the structure at the base of the boss 31. By contrast, the depth of the notch 36 is sufficient to fracture the boss 31 at the base when a tension force is applied thereto by lifting the frusto-conical cup 20. This causes the boss 31 to drop away and free the frusto-conical cup, again witnessing the act, in similar fashion to the separable portion 32. The boss 31, itself, in this case, is the analogous tamper-indicating mechanism.

In an alternative embodiment of the present invention, the solid dosage product 4 is omitted. In such a case, the chamber 25 is no longer needed and the bottom 23 of the frusto-conical cup 20 may rest on or near the top surface 3 of the closure 2. With dosage gradation marks 26 (not shown) applied to the frusto-conical cup 20, the same may be used for measuring out doses of a liquid product. The dosage gradation marks 26 may be applied by imprinting or embossing techniques known in the art.

The frusto-conical cup 20 may be formed by injection molding. While any suitable thermoplastic resin may be used, the preferred resin is one of low toughness, such as polystyrene (PS) or poly methyl methacrylate (PMMA). Moldings with these resins can be rendered flexible with sufficiently thin wall design. Because of the multiple undercuts in the preferred embodiment involving the separable portion 32, actions within the mold to manipulate steel withdrawal from the undercuts will be complex. Such complexities drive up the mold cost and lengthen the cycle time, hence the incremental cost of the molded part.

Figure 12:
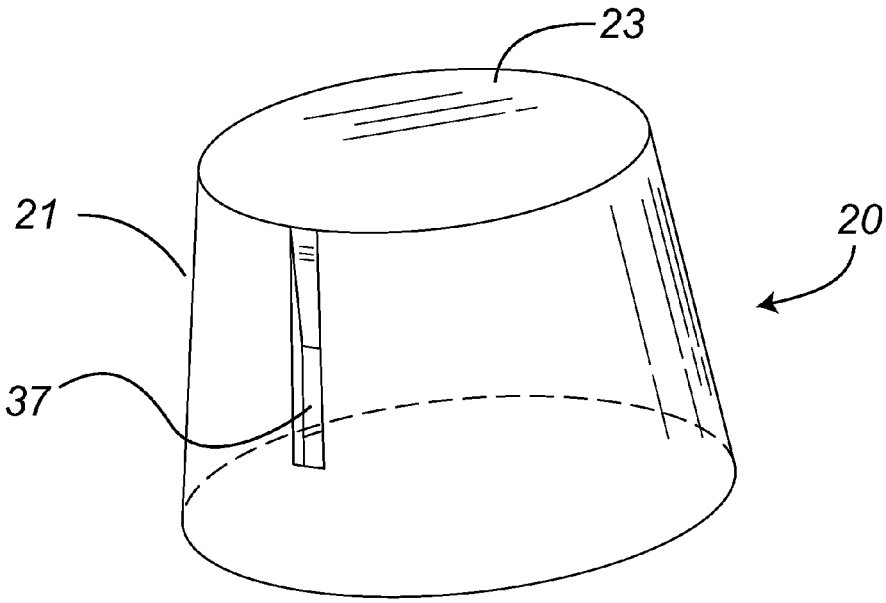
FIG. 12 is a perspective view of an alternate embodiment of the dose cup.
Figure 13:
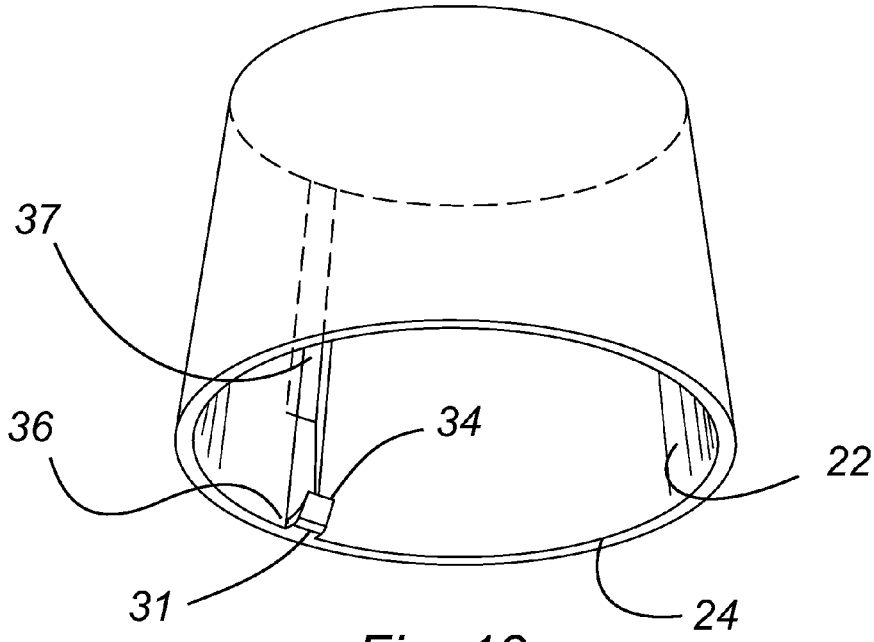
FIG. 13 is a bottom perspective view of the alternate embodiment of the dose cup.

The alternate embodiment involving the notch 36 addresses the undercut dilemma by providing a tooling aperture 37 (see FIG. 12). The tooling aperture 37 allows shutoffs around the notch and boss undercuts in a straight pull of the mold core without collateral actions. In this way, the mold design is simplified and the cycle efficiency improved. The tooling aperture 37, however, renders the frusto-conical cup 20 unsuitable for holding a liquid product of any volume, and, consequently, makes it of limited usefulness for the alternative embodiment of the present invention. This usefulness can be significantly improved, on the other hand, by decreasing the slope of the flared sidewall 21. This would have the effect of narrowing the tooling aperture 37 and moving it toward the top of the frusto-conical cup 20, whereby the volume of contained liquid would scalably increase.

The water bottle 10 can be formed by known methods in a variety of thermoplastic materials. In the preferred embodiment, the bottle is blow-molded from polyethylene terephthalate (PETE), which is a clear resin of the polyester family. Similarly, production methods and materials for the closure 2 can be selected from those well known by practitioners in the art. In the preferred embodiment, closure 2 is injection molded from one, or a combination of, polypropylene (PP) or polyethylene (PE), both of which are commodity resins generically known as polyolefin's. Solid dosage product 4 can be granulated, compressed, or comminuted in accordance with known methods, typically in the domain of pharmaceuticals.

It is to be understood that the invention is not limited in its application to the details of construction and to the arrangements of the components set forth in the preceding description or illustrated in the drawings. For example, there may be more than one separable portion 32, or more than one notch 36. Also, it is to be understood that the phraseology and terminology employed herein are for the purpose of the description and should not be regarded as limiting.

What is claimed is:

1. An enhanced water product with a safety feature, comprising:

a water bottle containing water and having a neck finish and a neck flange;

a closure sealingly fitted to the neck finish, the closure having a top surface;

an inverted frusto-conical cup having a flexible sidewall with an interior surface, a top rim and a bottom, the top rim having a diameter broader than the neck flange, the sidewall interior surface resting on the neck flange to form a chamber there between the bottom and the top surface of the closure;

a solid dosage product contained within the chamber; and a means for frangibly coupling the inverted frusto-conical cup to the neck flange without the application of heat applied in the coupling thereto;

whereby the means for frangibly coupling is engaged during the act of assembling the inverted frusto-conical cup to the water bottle, and wherein the means for frangibly coupling provides both physical and tamper-indicating security of the assembly.

2. The enhanced water product of claim 1, further comprising the solid dosage product protected within a sealed pouch.

3. The enhanced water product of claim 1, wherein the means for frangibly coupling comprises a boss extending radially inward and angularly upward from the sidewall interior surface, the boss capable of flexing out of the way during passage over the neck flange and of snagging there under to form the engagement.

4. The enhanced water product of claim 3, wherein the top rim diameter is sufficiently broad as to allow the flexed boss to bypass the flange when the sidewall is flexed into an ovate shape during assembly.

5. The enhanced water product of claim 3, wherein the engaged boss separates from the sidewall and releases the inverted frusto-conical cup when a predetermined force is applied thereto, the separation constituting a telltale of the act.

6. The enhanced water product of claim 5, wherein the boss is attached to a separable portion of the sidewall.

7. The enhanced water product of claim 6, wherein a plurality of breakable filaments attach the separable portion to the sidewall.

8. The enhanced water product of claim 7, wherein the predetermined force is a hand pressure applied to the inverted frusto-conical cup of sufficient strength and lift direction to break the breakable filaments.

9. The enhanced water product of claim 1, wherein the inverted frusto-conical cup is visually transparent.

10. The enhanced water product of claim 1, wherein the solid dosage product is a nutritional supplement in tablet or capsule form.

11. A liquid product with a safety feature, comprising:

a bottle containing liquid and having a neck finish and a neck flange;

a closure sealingly fitted to the neck finish;

an inverted frusto-conical cup having a flexible sidewall with an interior surface and a top rim, the top rim having a diameter broader than the neck flange, the interior sidewall surface resting on the neck flange; and a means for frangibly coupling the inverted frusto-conical cup to the neck flange without the application of heat applied in the coupling thereto;

whereby the means for frangibly coupling is engaged during the act of assembling the inverted frusto-conical cup to the bottle, and wherein the means for frangibly coupling provides both physical and tamper-indicating security of the assembly.

12. The liquid product of claim 11, wherein the means for frangibly coupling comprises a boss extending radially inward and angularly upward from the sidewall interior surface, the boss capable of flexing out of the way during passage over the neck flange and of snagging there under to form the engagement.

13. The liquid product of claim 12, wherein the top rim diameter is sufficiently broad to allow the flexed boss to bypass the flange when the sidewall is flexed into an ovate shape during assembly.

14. The liquid product of claim 12, wherein the engaged boss separates from the sidewall and releases the inverted frusto-conical cup when a predetermined force is applied thereto, the separation constituting a telltale of the act.

15. The liquid product of claim 14, wherein the boss is attached to a separable portion of the sidewall.

16. The liquid product of claim 15, wherein a plurality of breakable filaments attach the separable portion to the sidewall.

17. The liquid product of claim 16, wherein the predetermined force is a hand pressure applied to the inverted frusto-conical cup of sufficient strength and lift direction to break the breakable filaments.

18. The liquid product of claim 11, wherein the inverted frusto-conical cup has dosage graduations marked thereon.

* * * * *